United States Patent [19]

Ruhter et al.

[11] Patent Number: 4,696,350

[45] Date of Patent: Sep. 29, 1987

[54] MOTOR GRADER WITH SADDLE MOUNTED TO TRANSVERSE PIN ON MAIN FRAME

[75] Inventors: Martin L. Ruhter; Dennis A. Brimeyer; David W. Stubben, all of Dubuque, Iowa

[73] Assignee: Deere & Company, Moline, Ill.

[21] Appl. No.: 780,048

[22] Filed: Sep. 25, 1985

[51] Int. Cl.[4] ..... E02F 3/80

[52] U.S. Cl. ..... 172/793; 37/108 R; 172/753; 280/760; 403/387

[58] Field of Search ..... 172/776, 781, 789, 791, 172/793, 795, 796, 797, 780, 782, 783, 784, 785, 786, 787, 788, 790, 792, 794, 798, 799, 753; 403/387, 388; 180/11, 235; 280/760; 37/108 R, 231, 234, 235, 236, DIG. 13

[56] References Cited

U.S. PATENT DOCUMENTS

| | | | |
|---|---|---|---|
| 2,237,586 | 4/1941 | Cost et al. | 172/781 |
| 2,858,153 | 10/1958 | Petersen | 403/388 |
| 3,327,413 | 6/1967 | Brinkmeyer et al. | 172/793 X |
| 3,415,554 | 12/1968 | Papayoti | 403/388 X |
| 3,454,110 | 7/1969 | Hanser | 172/793 |
| 3,986,563 | 10/1976 | Stubben | 172/793 |
| 4,496,261 | 1/1985 | Cohen et al. | 403/388 X |

*Primary Examiner*—Richard T. Stouffer

[57] ABSTRACT

A saddle construction for use in a motor grader having a fore-and-aft extending main frame comprising an upper portion having a generally longitudinal extending section forming a forward facing and a rear facing. The facings have a generally vertical orientation. The main frame has first and second pins slidably mounted transversely in the main frame in longitudinal spaced apart relationship. The forward facing of the saddle upper portion straddles the main frame and is fixably mounted to opposite ends of the first pin. In like manner, the rear facing straddles the main frame and is fixably mounted to opposite ends of the second pin. The saddle further includes a lower portion straddling the main frame and fixably mounted the rear facing. The main frame has a plurality of recesses formed in respective side walls of the main frame in longitudinal spaced apart relationship for seatably receiving inwardly directed landings formed on the facings.

4 Claims, 5 Drawing Figures

MOTOR GRADER WITH SADDLE MOUNTED TO TRANSVERSE PIN ON MAIN FRAME

BACKGROUND OF THE INVENTION

This invention relates to motor graders and, more particularly, to mounting of the saddle structure to the longitudinal main beam of the motor grader.

Conventionally, an articulated motor grader is comprised of a fore-and-aft extending main beam supported forwardly on wheels. The rear portion of the main beam is hinged to a tractor section supported on traction wheels. A saddle structure is customarily mounted to the main beam for suspendably supporting a ground engaging blade through a linkage responsible for angularly adjusting and laterally positioning the blade. A draw bar is swivelably mounted at one end to the forward section of the main beam and at the other end to the linkage.

During the grading operation, blade loads are transmitted to the main beam through the drawbar and linkage. At the forward end, the drawbar transmits axial, lateral and vertical loads to the main beam. Being restrained at its rear end by the linkage, the drawbar transmits, through the linkage and saddle, vertical, lateral and torsional loads to the main beam. Therefore, the main beam, in the area of the saddle structure, is subjected to high, complex loads.

It has been customary to weld the saddle structure or mounting parts for the saddle structure to the main beam. Stress levels were reduced by adding reenforcement to the main beam in the area of the saddle. The use of these techniques represented a substatial cost and, in some circumstances, unwanted additional vehicle weight.

SUMMARY OF THE INVENTION

It is an objective of the present invention to present a saddle and mounting therefor which does not necessitate the inclusion of main frame reenforcements. It is further objective of the present invention to present a saddle and mounting therefor which substantially reduces the stress level experienced by the main frame in the saddle mounting region. It is a still further objective of the present invention to present a saddle which has enhanced serviceability and repair characteristics.

The main frame includes, along the top edge, and within the saddle mounting region a plurality of milled recesses in each of the side walls in longitudinal spaced relationship. Another milled recess is provided in each side wall along the bottom edge of the main beam. A first hole is formed in each of the main frame side walls in transverse axial alignment and a boss is mounted in each of the first holes. Forward of the first holes, a second hole is formed in each sidewall in transverse axial alignment and a boss is mounted in each of the second holes. A first pin is slidably mounted axially in the first hole bosses and a second pin is slidably mounted axially in the second hole bosses.

The saddle is comprised of an upper and a lower portion. The upper portion has a longitudinal extending top wall joined to a vertically extending forward facing having a formed vertically downward open well. The top wall is also joined to a rear facing simularily having a formed vertically downward open well. The well of each of the forward and rear facings includes bearing tabs formed on the respective inner side wall of each well. The bearing tabs reside in the recesses provided in the upper edges of the main frame sidewalls. The rear facing further includes a pain of transversely spaced mounting members, each mounting member having a horizontally rearwardly open recess matingly receiving an end of the first pin. The forward facing is fixably mounted to the ends of the second pin. Saddle side members extend longitudinally between the forward and rear facings. The lower portion of the saddle is fixably mounted to each of the mountng members to straddle the lower portion of the main frame and is provided with bearing tabs which reside in the recesses provided in the lower edges of the sidewalls.

With the structure according to the invention, vertical, torsional and axial loads are transmitted into the main frame by the pins while lateral loads are transmitted directly from the saddle. Further, the saddle can be easily disassembled for easy servicing. Other benefits of the present invention will be observed from the subsequent detailed description of the preferred embodiment.

DETAILED DESCRIPTION OF THE PREFERRED EMBODIMENT

Figure 1:
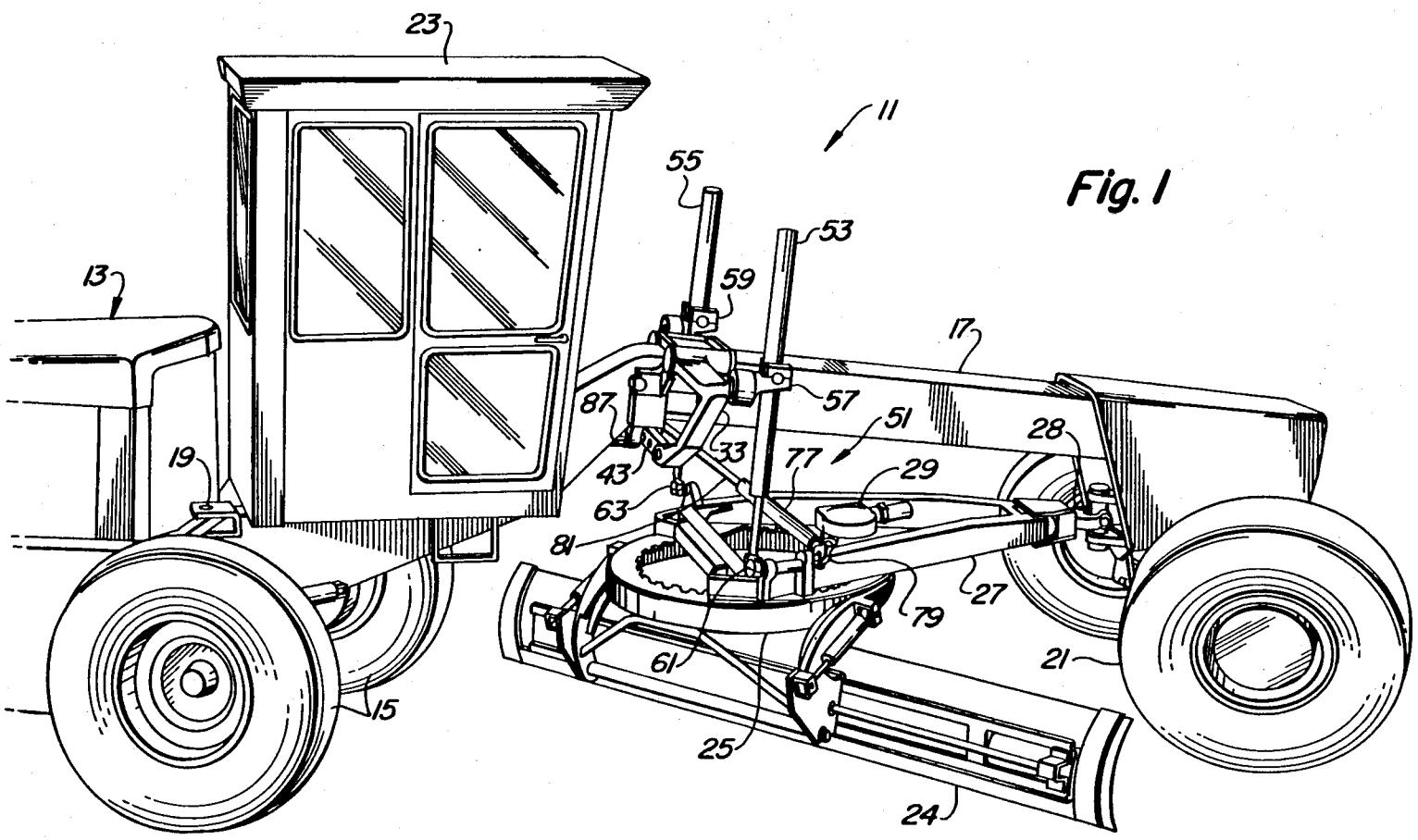
FIG. 1 is a partial side prospective view of a motor grader having a blade saddled to the motor grader in accordance with the present invention.
Figure 4:
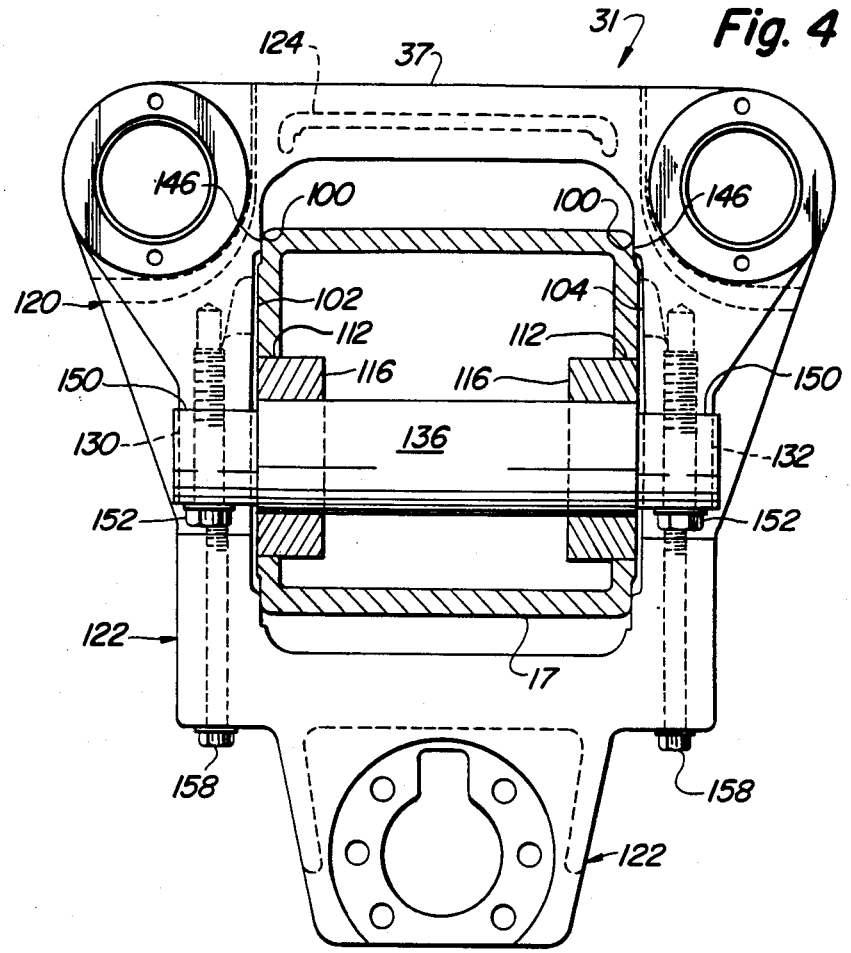
FIG. 4 is a sectioned frontal view of the saddle and main frame mounting along line 4—4.
Figure 2:
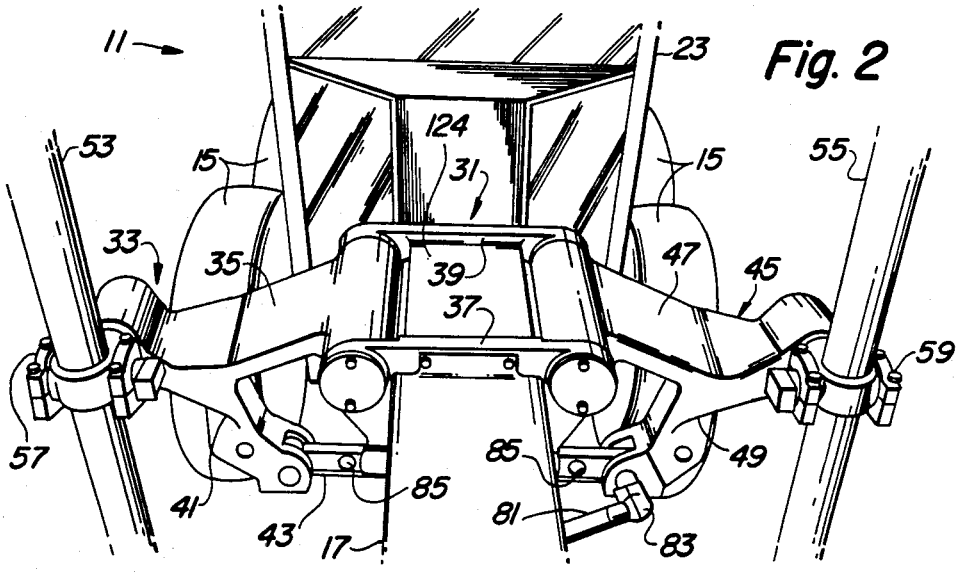
FIG. 2 is a partial frontal prospective view of the motor grader.
Figure 3:
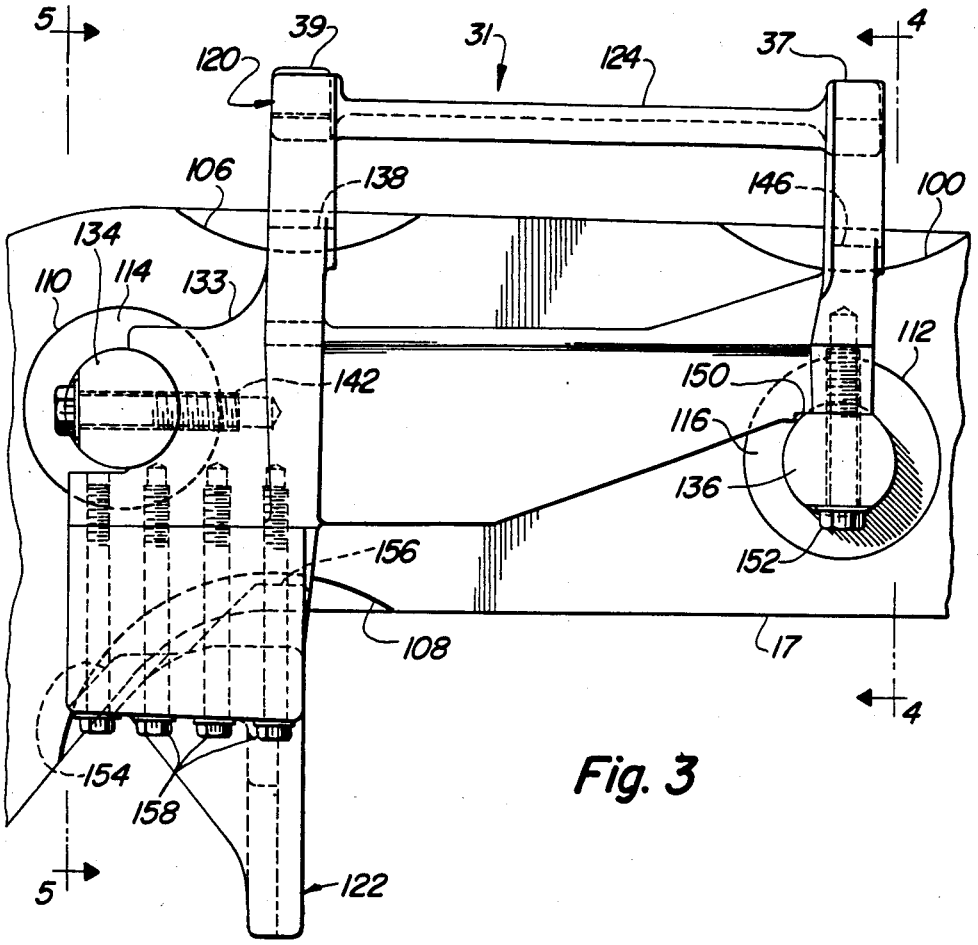
FIG. 3 is a partial side view of the saddle in accordance with the present invention.
Figure 5:
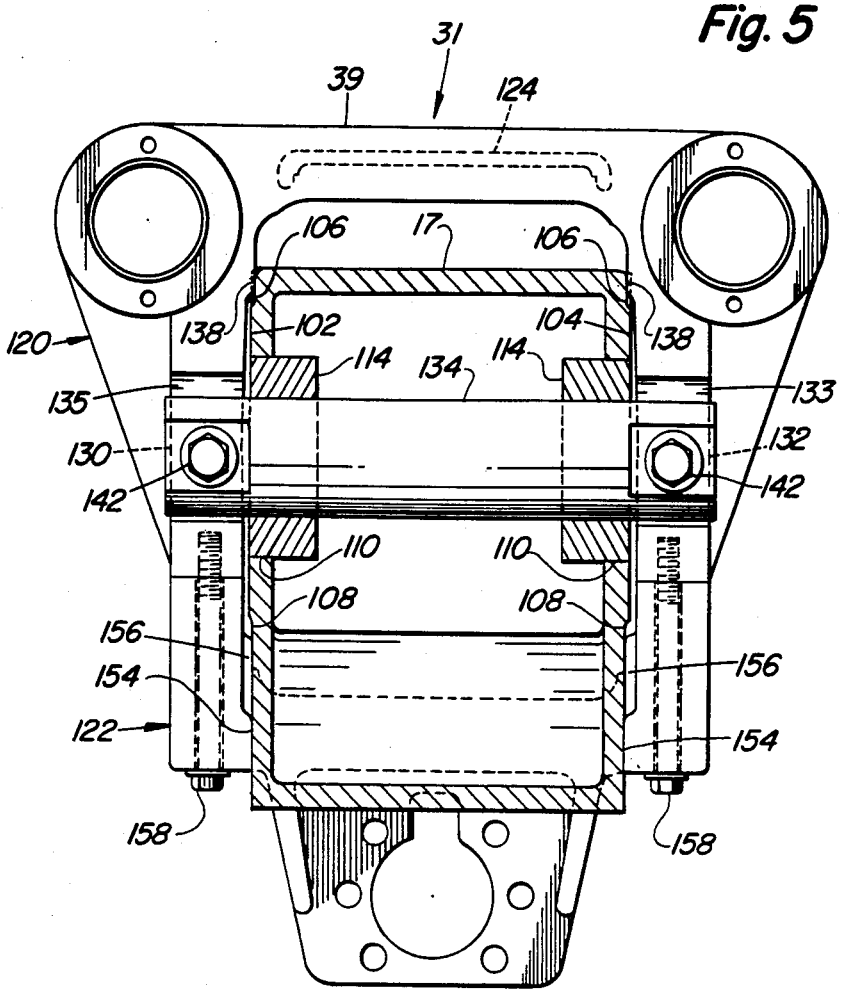
FIG. 5 is a sectional rear view of the saddle and main frame mounting along line 5—5.

Referring to FIGS. 1 and 2, the motor grader, generally indicated as 11, is comprised of a rearwardly located tractor 13 supported on wheels 15 and a main frame 17 extending fore-and-aft. The frame 17 is hinged to the tractor 13 at the sft location 19 and supported forwardly by steering wheel 21. An operator's station 23 is supported on the rear portion of the main frame 17. Suitable controls and steering mechanism are provided in the operator station 23 so that an operator may operate the various hydraulic units of the motor grader as well as steer the motor grader. Suspended beneath the main frame 17 is a grader blade 24 suitably carried in a conventional manner by a circle 25. The circle 25 carries an internal gear suitably controlled for rotation by a hydraulic motor 29 fixably mounted to a drawbar 27. The forward end of the drawbar 27 is swivelly mounted forwardly to the main frame 17 by conventional means such as by universal connector 28 and the rear end is connected to the circle 25.

A saddle 31 is mounted to the main frame 17 in a manner more fully described subsequently. A first generally Y-shaped bell crank 33 has one of its crank arms 35 pivotally mounted to the saddle 31 between front and rear saddle facings 37 and 39 in a conventional manner. The other crank arm 41 of bell crank 33 is pinned to one end of a crossbar 43. A second generally Y-shaped bell crank 45, in like manner to bell crank 33, has one crank arm 47 pivotally mounted to saddle 31 between saddle facings 37 and 39 and the other crank arm 49 in pinned to the other end of crossbar 43. The bell cranks 33 and 45 are positioned on opposite sides of main frame 17.

The grader blade suspension linkage, generally indicated as 51, inclusive of bell cranks 33 and 45 and crossbar 43 further includes extensible and retractable hydraulic lift actuators 53 and 55 having cylinder portions swivelably connected to a respective bell crank 33 and 45 through respective swivel connectors 57 and 59. The rod portions of lift actuators 53 and 55 are swivelably connected at their ends to drawbar 27 in a transversely spaced apart relationship by any conventional means such as by universal connectors 61 and 63, respectively. Further, an extensible and retractable hydraulic side shift actuator 77 is swivelably mounted to drawbar 27 at one end by means such as a universal swivel connector 79. The actuator 77 extends generally diagonally and transversely relative to the main frame 17 such that the actuator rod 81 is swivelably connected to arm 49 of bell crank 45 by means such as universal swivel connector 83.

The crossbar 43 has a plurality of fore-and-aft directed locking pin apertures 85 formed therein in transversely spaced apart relationship. A locking pin means 87 such as described in U.S. Pat. No. 3,986,563 is fixably mounted to the saddle 31 for cooperating with the locking pin apertures 85 in crossbar 43.

Referring more specifically to FIG.'s 3, 4 and 5, to accommodate mounting of saddle 31, the main frame 17 includes a pair of first vertically downward directed recesses 100 in the upper edges of the left-hand and right-hand sidewalls 102 and 104 of the frame 17 in transverse alignment. A pair of second vertically downward directed recesses 106 are formed in the upper edges of the left-hand and right-hand sidewalls 102 and 104 in transverse alignment. The recesses 106 are rearward of recesses 100. A plurality of third vertically upward directed recesses 108 are formed in the lower edges of the left-hand and right-hand sidewalls 102 and 104 of main frame 17 in transverse alignment and generally below the recesses 106. The recesses 100, 106 and 108 are formed by any conventional means such as milling.

The frame 17 sidewalls 102 and 104 each contain an aft-hole 110 and a forward hole 112. The holes 110 in respective sidewalls 102 and 104 are in transverse alignment and, in like manner, holes 112 are in transverse alignment. The holes 110 and 112 are positioned in close proximity to the longitudinal neutral axis of the frame 17. Bosses 114 and 116 are fixably mounted in the holes 110 and 112 respectively, by any conventional means such as welding.

The saddle 31 includes an upper portion 120 and a lower portion 122. The upper saddle portion 120 is comprised of a longitudinal extending member 124 joined to and disposed between forward and rear facings 37 and 39. Side struts 130 and 132 extend between the forward facing 37 and rear facing 39 of the upper saddle portion 120. Formed on the rear facing 39 and extending rearwardly are first and second seat members 133 and 135 in spaced apart transverse alignment.

A first pin 134 is mounted in bosses 114 with its ends extending beyond the sidewalls 102 and 104, and a second pin 136 is mounted, in like manner to pin 134, in bosses 116 with its ends extending beyond the sidewalls 102 and 104. The upper portion 120 of the saddle 31 is placed lengthwise on the frame 17 such that the forward and rearward facings 37 and 39 straddle the frame 17. The rearward facing 39 includes inner landings 138 which are press fit or tightly seated in frame recesses 106. In addition, the seat members 133 and 135 of facing 39 are provided with rearwardly open recesses which seat in part around the ends of pin 134. Bolts 142 pass through horizontal openings provided in the ends of pin 134 and are threaded into the seat members 133 and 135. The forward facing 37 includes inner landings 146 which are press fit or tightly seated in frame recess 100. In addition, the forward facing rests on horizontal landings 150 formed at the ends of pin 136. Bolts 152 extend through vertical openings provided in the ends of pin 136 and are threaded into forward facing 37.

The lower portion 122 of saddle 31 is positioned straddling the underside of main frame 17. The lower portion 122 includes inner landings 154 and 156 which are press fit or tightly seated in frame recesses 108. The lower portion 122 is also secured to the respective seat members 133 and 135 by a plurality of bolts 158 extending through the lower portion 122 and threaded into the seat members.

It will be appreciated by those skilled in the art that the uniform main frame section existing throughout the saddle mounting area avoids high localized stresses, thereby obviating the need for reinforcing the main frame in the saddle mounting area. Further, the saddle and mounting arrangement, therefore, allows the saddle to be easily disassemble for servicing.

The above description is of the preferred embodiment of the invention and should not be held as limiting. The scope of the invention is defined by the following claims.

What is claimed is:

1. In a motor grader having a fore-and-aft extending main frame, a saddle comprising:

an upper portion having a generally longitudinal extending section joining spaced apart forward and rear facings, said facings having a generally vertical orientation;

said main frame having a first pin and a second pin mounted transversely in the main frame in longitudinal spaced apart relationship; and said forward facing straddling said main frame and fixably mounted to opposite ends of said first pin, and said rear facing straddling said main frame and fixably mounted to opposite ends of said second pin.

2. A saddle as claimed in claim 1, further comprising:

a lower portion fixably mounted to at least one of said facings of said upper portion and straddling said main frame opposite said upper portion.

3. A saddle as claimed in claim 1 wherein said saddle further comprises:

said main frame having first and second recesses formed in each of two laterally spaced sidewalls of said main frame in longitudinal spaced apart relationship, said first recesses being transversely aligned and said second recesses being transversely aligned;

said forward facing having inwardly directed landings seatably received in a respective one of said first reecesses; and, said rear facing having inwardly directed landings seatably received in a respective one of said second recesses.

4. In a motor grader having a fore-and-aft extending main frame, a saddle comprising:

an upper portion having a generally longitudinal extending section joining a forward facing and a rear facing, said facings having a generally vertical orientation and held in longitudinal spaced apart relationship by said longitudinal extending section;

said main frame having a first pin and a second pin mounted transversely in said main frame in longitudinal spaced apart relationship;

said upper portion having said forward facing straddling said main frame and fixably mounted to opposite ends of said first pin, and said rear facing straddling said main frame and fixably mounted to opposite ends of said second pin;

a lower portion fixably mounted to at least one of said facings of said upper portion and straddling said main frame opposite said upper portion;

said main frame having first and second recesses formed in each of two laterally spaced sidewalls of said main frame in longitudinal spaced apart relationship with said first recesses in transverse alignment and said second recesses in transverse alignment;

said forward facing having inwardly directed landings seatably received in said first recesses; and said rear facing having inwardly directed landings seatably received in said second recesses.

* * * * *